US009517620B2

(12) United States Patent
Okajima et al.

(10) Patent No.: US 9,517,620 B2
(45) Date of Patent: Dec. 13, 2016

(54) PRINTING DEVICE AND PRINTING METHOD

(71) Applicant: MIMAKI ENGINEERING CO., LTD., Nagano (JP)

(72) Inventors: Masakazu Okajima, Nagano (JP); Eiichi Ohara, Nagano (JP); Junki Kasahara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/036,415

(22) PCT Filed: Nov. 13, 2014

(86) PCT No.: PCT/JP2014/080112
§ 371 (c)(1),
(2) Date: May 12, 2016

(87) PCT Pub. No.: WO2015/072524
PCT Pub. Date: May 21, 2015

(65) Prior Publication Data

US 2016/0288490 A1 Oct. 6, 2016

(30) Foreign Application Priority Data

Nov. 15, 2013 (JP) ..... 2013-237317

(51) Int. Cl.
*B41J 2/14* (2006.01)
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/145; B41J 19/142; B41J 11/42; B41J 19/147; B41J 29/38; B41J 11/425; B41J 2/04541
See application file for complete search history.

(56) References Cited

U.S. PATENT DOCUMENTS 8,845,063 B2 * 9/2014 Sano ..... B41J 2/07 347/15
8,888,219 B2 * 11/2014 Tanase ..... B41J 2/12 347/13
8,964,242 B2 * 2/2015 Kuno ..... G06K 15/105 347/40

FOREIGN PATENT DOCUMENTS

JP H07-276643 10/1995
JP 2005-199563 7/2005
(Continued)

OTHER PUBLICATIONS

"International Search Report (Form PCT/ISA/210) of PCT/JP2014/080112", mailed on Dec. 16, 2014, with English translation thereof, pp. 1-4.

*Primary Examiner* — Lamson Nguyen
(74) *Attorney, Agent, or Firm* — Jianq Chyun IP Office

(57) ABSTRACT

A printing device is provided and includes: a head unit and a controller. The head unit performs a main scan operation corresponding to each of a predetermined N-number of printing passes (N is an integer of three or greater) on a same area of a medium in a multi-pass mode, and the controller sets a density of printing to be performed in a k-number of last printing passes (k is an integer which is equal to or greater than 1 and is less than N), so as to be lower than a density of printing to be performed in the (N−k)-th printing pass, and sets a density of printing to be performed by a plurality of individual nozzles of the nozzle row of the head unit for ejecting ink drops in the (N−k+1)-th printing pass, so as to gradually decrease toward a head rear end side.

7 Claims, 8 Drawing Sheets

(56) References Cited

FOREIGN PATENT DOCUMENTS

| | | |
|---|---|---|
| JP | 2006-150790 | 6/2006 |
| JP | 2012-6258 | 1/2012 |

* cited by examiner

PRINTING DEVICE AND PRINTING METHOD

CROSS-REFERENCE TO RELATED APPLICATION

This application is a 371 of international application of PCT application serial no. PCT/JP2014/080112, filed on Nov. 13, 2014, which claims the priority benefit of Japan application no. JP 2013-237317, filed on Nov. 15, 2013. The entirety of each of the above-mentioned patent applications is hereby incorporated by reference herein and made a part of this specification.

TECHNICAL FIELD

The disclosure relates to a printing device and a printing method.

BACKGROUND ART

In the related art, inkjet printers for performing printing in an inkjet scheme are widely used. Also, as ink which is used in inkjet printers, ultraviolet curing ink which hardens when irradiated with ultraviolet light is widely used (see Patent Literature 1 for instance).

CITATION LIST

Patent Literatures

Patent Literature 1: JP-A-2005-199563

SUMMARY

Technical Problems

In inkjet printers, in a case of using ultraviolet curing ink, it is general to perform printing in a multi-pass mode for performing printing on each position of media in a plurality of printing passes. However, in the case of performing printing in the multi-pass mode, the states of print results at areas of printing pass widths may be different from one another, whereby strip patterns (such as light stripes) may be generated. Especially, in the case of using ultraviolet curing ink, when high-accuracy printing is performed at a high speed, generation of such strip patterns may be a big problem. For this reason, in the related art, it has been required to suppress generation of such strip patterns and perform printing by a more appropriate method, in the case of using ultraviolet curing ink in inkjet printers. It is therefore an object of the disclosure to provide a printing device and a printing method capable of solving the above described problem.

Solutions to Problems

In inkjet printers, the state of a print result is determined according to various conditions. Therefore, for example, even if a printing failure of a certain state occurs, it is not easy to determine the cause of the failure. Also, more specifically, the cause of occurrence of linear areas as described in a case of using ultraviolet curing ink in an inkjet printer has not been sufficiently clarified in the related art.

For this reason, the inventors of this application made earnest researches on the cause of occurrence of strip patterns. Then, first, the inventors found that an immediate cause of conspicuous strip patterns is significantly related with non-uniformity in the shapes of ink dots which are formed in the surface layer part (uppermost part) of an ink layer which is performed on a medium after printing.

Here, non-uniformity in the shapes of ink dots is caused, for example, by connection of unhardened ink dots on the medium. Also, in a case of using ultraviolet curing ink in an inkjet printer, among ink dots which are formed on a medium in a multi-pass mode, only some ink dots are formed in the surface layer part of an ink layer, and the other ink dots function as base at a lower layer of the ink layer. Also, more specifically, in a case of performing printing, for example, at a resolution of 600 dpi by a general inkjet printer which is widely used in recent years, ink dots which are formed in a surface layer part are about 20% of the whole ink dots, and the other ink dots of 80% function as base.

Further, with respect to a printing pass for forming ink dots of a surface layer part among a plurality of printing passes for performing printing in a multi-pass mode, the inventors of this application first examined a case of performing printing at density lower than those of the other printing passes. In this case, the density of a printing pass mean density corresponding to the density of ink dots to be formed, for example, in a band area of a printing pass width, in the corresponding printing pass. According to this configuration, with respect to ink dots to be formed in a printing pass, for example, it is possible to make the distances between adjacent dots sufficiently large, thereby making connection of dots difficult. Also, by this, it can be considered that it is possible to further uniformize the shapes of ink dots of a surface layer part of an ink layer.

However, by more earnest researches, the inventors of this application found that, if the densities of the last printing pass are only set to density lower than those of the other printing passes, the boundaries between the printing passes may be conspicuous. Also, the inventors found that the cause of that problem is significantly related to a manner to change the density of the printing passes. More specifically, for example, in a case of changing the density of the individual printing passes only in units of a printing pass, the density of the last printing pass vary stepwise as compared to the density of the previous printing pass. However, in a case where densities significantly vary at specific boundaries in an inkjet printer, those boundaries become conspicuous. Therefore, it can be considered that, if the densities of the last printing pass are only set to density lower than those of the other printing passes, the boundaries between the printing passes may be conspicuous.

Therefore, the inventors of this application thought a method of gradually changing the density of the printing passes even in the printing passes, not a method of only changing the density in a step manner in units of a printing pass. Also, the inventors found that, if the densities are changed as described above, it is possible to prevent the boundaries between the printing passes from becoming conspicuous, and it is possible to more appropriately perform printing. In order to achieve the above described object, the disclosure has the following configurations.

(First Configuration)

A printing device which performs printing in an inkjet scheme includes: a head unit, including a nozzle row in which a plurality of nozzles for ejecting ink drops of ultraviolet curing ink onto a medium is lined up; a main scan driver, driving the head unit to perform a main scan operation of ejecting ink drops while moving along a main scan direction which is predetermined; a sub scan driver, relatively moving the head unit with respect to the medium along a sub scan direction perpendicular to the main scan direction; and a controller, controlling the main scan operation of the head unit, wherein, in the nozzle row of the head unit, the plurality of nozzles is lined up along the sub scan direction, and the head unit performs printing on the medium in a multi-pass mode for performing multiple times of the main scan operation on a same area of the medium, and performs the main scan operation corresponding to each of a predetermined N-number of printing passes (wherein N is an integer of three or greater) on the same area of the medium, and the controller sets at least a density of printing to be performed in a k-number of last printing passes (wherein k is an integer which is equal to or greater than 1 and is less than N) of the N-number of printing passes to be performed on the same area of the medium, so as to be lower than a density of printing to be performed in the (N−k)-th printing pass, and in a case where a direction from a nozzle of the nozzle row of the head unit for ejecting ink drops in the first printing pass of the N-number of printing passes toward a nozzle for ejecting ink drops in a N-th printing pass is referred to as a head rear end side, the controller sets a density of printing to be performed by a plurality of individual nozzles of the nozzle row of the head unit for ejecting ink drops in the (N−k+1)-th printing pass, so as to gradually decrease toward the head rear end side.

In this configuration, for example, the printing density of the k-number of printing passes including the last printing pass are set so as to be low, whereby it is possible to reduce, for example, the density of ink dots to be formed in a surface layer part of an ink layer, thereby making it difficult for dot connection and the like to occur. Also, by this, it is possible to appropriately uniformize the shapes of ink dots in the surface layer part of the ink layer. Therefore, according to this configuration, it is possible to appropriately suppress occurrence of strip patterns of a printing pass width and the like, for example, in a case of performing printing in the multi-pass mode using ultraviolet curing ink.

Also, in this configuration, with respect to the (N−k+1)-th printing pass for which printing density are set to be lower than those of the previous printing pass, the density of the whole printing pass are not set to be uniformly low, but the density to be performed by the plurality of individual nozzles for ejecting ink drops in the corresponding printing pass are set so as to gradually decrease toward the head rear end side. In this case, the printing densities do not significantly change stepwise in units of a printing pass.

Therefore, according to this configuration, for example, it is possible to appropriately prevent the boundaries between the printing passes from becoming conspicuous. Also, by this, for example, it is possible to more appropriately suppress occurrence of strip patterns and the like. Also, by suppressing occurrence of strip patterns and the like, for example, with respect to a case of using ultraviolet curing ink in the inkjet printer, it is possible to perform printing by a more appropriate method.

Also, to set the density of printing to be performed by the plurality of individual nozzles for ejecting ink drops in the (N−k+1)-th printing pass so as to gradually decrease toward the head rear end side means to set the printing density corresponding to the individual nozzles so as to decrease, for example, toward the head rear end side. In this case, the density of all nozzles are not always set to be different from one another, and the density of some nozzles may be set so as to be the same as those of adjacent nozzles. For example, the density of printing to be performed by the individual nozzles may be gradually changed in units of a predetermined number of nozzles. Also, the density of printing to be performed by the individual nozzles may be gradually changed, more finely, in units of one nozzle.

(Second Configuration)

The controller sets at least a density of printing to be performed in the last one printing pass of the N-number of printing passes to be performed on the same area of the medium, so as to be lower than a density of printing to be performed in the (N−1)-th printing pass, and the controller sets a density of printing to be performed by the plurality of nozzles of the nozzle row of the head unit for ejecting ink drops in the last one printing pass, so as to gradually decrease toward the head rear end side.

In this configuration, for example, with respect to the density of printing to be performed in the last printing pass, it is possible to appropriately set low density. Also, by that, it is possible to appropriately uniformize the shapes of ink dots, for example, in the surface layer part of the ink layer. Also, with respect to the last one printing pass, it is possible to appropriately prevent the boundaries between printing passes from becoming conspicuous. Therefore, according to this configuration, for example, with respect to a case of using ultraviolet curing ink in the inkjet printer, it is possible to perform printing by a more appropriate method. Also, a printing pass for which density decrease does not need to be limited to the last printing pass. For example, in the second last printing pass, the density may be set to be lower than those of the previous printing pass.

(Third Configuration)

The main scan driver drives the head unit to perform the main scan operation in each direction of an outward direction which is predetermined in the main scan direction, and a homeward direction opposite to the outward direction, and the sub scan driver relatively moves the head unit with respect to the medium in each of an interval between the main scan operation which is performed while the head unit moves in the outward direction and the main scan operation which is performed while the head unit moves in the homeward direction, and the interval between the main scan operation which is performed while the head unit moves in the homeward direction and the main scan operation which is performed while the head unit moves in the outward direction.

According to this configuration, for example, it is possible to appropriately perform printing on each area of a medium in the multi-pass mode. Also, in this case, by performing a sub scan operation of relatively moving a printing unit with respect to a medium along the sub scan direction after a main scan operation of each of an outward way and a homeward way, it is possible to form ink dots on the same area of the medium in each of the outward way and the homeward way by the different nozzles of the head unit. Therefore, according to this configuration, it is possible to more appropriately uniformize the features of the nozzles and more appropriately perform printing with a high degree of accuracy.

Also, as a method of performing printing in a multi-pass mode, for example, it can be considered a method of performing the sub scan operation whenever the main scan operation is performed in both of the outward direction and the homeward direction, not performing the sub scan operation between the outward way and homeward way of the main scan operation. According to this configuration, for example, since a printing operation is performed in units of the outward way and the homeward way, it is difficult for differences in the printing properties between the outward way and the homeward way to influence a final print result. However, in this case, in the outward way and the homeward way, ink dots are formed in each area of a medium, by the same nozzles of the head unit. Therefore, in this case, it is impossible to uniformize the characteristics of the nozzles between the outward way and the homeward way. Also, for example, in a case where a deviation occurs in the ejection characteristic of any nozzle, the influence thereof exhibits more significantly. In contrast to this, in a configuration like the third configuration, as described above, it is possible to more appropriately uniformize the characteristics of the nozzles. Also, by this, it is possible to more appropriately perform printing with a high degree of accuracy.

(Fourth Configuration)

The controller sets a density of printing to be performed by the plurality of individual nozzles of the nozzle row of the head unit, such that, with respect to a central portion of the nozzle row in the sub scan direction, a manner of density variation in a direction toward a head front end side which is an opposite direction to the head rear end side becomes symmetrical to a manner of density variation in a direction toward the head rear end side.

In a case of performing printing in the multi-pass mode, it is required to adjust the total density of the printing density of the individual printing passes to a predetermined density with respect to each position of a medium. For this reason, for example, in a case where the density of any printing pass has been decreased, it is required to increase the density of other printing passes as much as the decrease. Also, in a case where density setting is not performed only in units of a printing pass, but is performed such that the density of printing to be performed by a plurality of nozzles for ejecting ink drops in any one printing pass gradually change, it is required to set the density of other printing passes such that the corresponding change is complemented.

However, this density setting for performing such complementation is not always easy, and may be complicated. For this reason, in a case of gradually changing the density of printing to be performed by the individual nozzles, it may be difficult to adjust the total of the printing density of the plurality of printing passes.

In contrast to this, in a configuration like the fourth configuration, for example, by making the manner of density variation have symmetry, it is possible to appropriately complement the density of printing to be performed by the individual nozzles between the head rear end side and the head front end side. Therefore, according to this configuration, it is possible to appropriately decrease the printing density of, for example, the last printing pass. Also, by this, it is possible to more appropriately uniformize the shapes of ink dots, for example, in the surface layer part of the ink layer.

(Fifth Configuration)

The controller sets a density of printing to be performed by the plurality of individual nozzles, such that a density of printing to be performed by the nozzles of the central portion of the nozzle row in the sub scan direction are higher than a density of printing to be performed by the nozzles of the ends of the nozzle row, and a density gradually decrease as a distance from the central portion increases.

According to this configuration, with respect to the printing density of the last printing pass or the like, it is possible to appropriately set low density. Also, by this, it is possible to more appropriately uniformize the shapes of ink dots, for example, in the surface layer part of the ink layer.

Also, in this configuration, the head unit may include a plurality of inkjet heads which is lined up in a staggered shape. In this case, the plurality of individual inkjet heads includes nozzle rows in which the nozzles are lined up, for example, along the sub scan direction, respectively. Also, in this case, the nozzle rows of the head unit may be, for example, nozzle rows configured by virtually connecting the nozzle rows of a plurality of individual inkjet heads in the sub scan direction.

(Sixth Configuration)

The head unit includes a plurality of inkjet heads which is lined up in a staggered shape, and the plurality of individual inkjet heads has nozzle rows in which the nozzles are lined up along the sub scan direction, respectively, and the controller sets a density of printing to be performed by the plurality of nozzles included in the nozzle rows of the individual inkjet heads, such that a density of printing to be performed by the nozzles of the central portion of the nozzle rows in the sub scan direction are high, and a density gradually decrease as a distance from the central portions increase.

According to this configuration, with respect to the printing density of the last printing pass or the like, it is possible to appropriately set low density. Also, by this, it is possible to more appropriately uniformize the shapes of ink dots, for example, in the surface layer part of the ink layer.

Also, in each inkjet head, deviations in landing positions and the like more easily occur by nozzles of the ends of each nozzle row than by nozzles of the central portion. In contrast to this, in this configuration, in each of the inkjet heads lined up in a staggered shape, with respect to the nozzles of the ends of each nozzle row, the printing density of the corresponding nozzles are set so as to be low. Therefore, for example, with respect to the individual inkjet heads, it is possible to appropriately reduce the influence of the nozzles of the ends of the nozzle rows. Also, by this, even in a case where deviations of landing positions and the like occur, for example, in the nozzles of the ends of the nozzle rows, it is possible to appropriately suppress their influence on print results. Therefore, according to this configuration, it is possible to appropriately set the density of each printing pass, for example, according to the configuration of the plurality of inkjet heads lined up in a staggered shape.

(Seventh Configuration)

A printing method of performing printing in an inkjet scheme includes: making a head unit, which includes a nozzle row in which a plurality of nozzles for ejecting ink drops of ultraviolet curing ink onto a medium is lined up, perform the followings: a main scan operation of ejecting ink drops while moving in a main scan direction which is predetermined; and a sub scan operation of relatively moving with respect to the medium along a sub scan direction perpendicular to the main scan direction, wherein, in the nozzle row of the head unit, the plurality of nozzles is lined up along the sub scan direction, and the main scan operation of the head unit is controlled such that the head unit performs printing on the medium in a multi-pass mode for performing multiple times of the main scan operation on a same area of the medium, and performs the main scan operation corresponding to each of a predetermined N-number of printing passes (wherein N is an integer of three or greater) on the same area of the medium, and in a control of the main scan operation, at least a density of printing to be performed in a k-number of last printing passes (wherein k is an integer which is equal to or greater than 1 and is less than N) of the N-number of printing passes to be performed on the same area of the medium are set so as to be lower than a density of printing to be performed in the (N−k)-th printing pass, and in a case where a direction from a nozzle of the nozzle row of the head unit for ejecting ink drops in a first printing pass of the N-number of printing passes toward a nozzle for ejecting ink drops in a N-th printing pass is referred to as a head rear end side, and a density of printing to be performed by a plurality of individual nozzles of the nozzle row of the head unit for ejecting ink drops in the (N−k+1)-th printing pass are set so as to gradually decrease toward the head rear end side. According to this configuration, for example, it is possible to achieve the same effects as those of the first configuration.

Advantageous Effects of Invention

According to the disclosure, it is possible to perform printing by a more appropriate method, for example, in a case of using ultraviolet curing ink in an inkjet printer.

BRIEF DESCRIPTION OF DRAWINGS

FIG. 1(*a*) and FIG. 1(*b*) are a front view and a top view illustrating an example of the configuration of a main portion of the printing device 10.

FIG. 2(*a*) shows the example of the overall configuration of the head unit 12 together with ultraviolet-light irradiation units 20. FIG. 2(*b*) shows an example of the configuration of a plurality of inkjet heads 202 which ejects ink drops of ink of the same color in the head unit 12.

FIG. 4(*a*) is a photo showing an example of a print result attributable to one main scan operation. FIG. 4(*b*) is an enlarged photo of a portion of the print result.

FIG. 5(*a*) is a graph illustrating an example of the relation between time from when an ink drop lands on a medium to when the ink drop is irradiated with ultraviolet light, and the height of an ink dot after hardening. FIG. 5(*b*) shows an example of an appearance of connection of ink dots. FIG. 5(*c*) shows an example of an appearance of ink dots which are formed in a last printing pass or the like.

FIG. 6(*a*) shows a first modification of density setting. FIG. 6(*b*) shows a second modification of density setting.

Hereinafter, embodiments according to the disclosure will be described with reference to the drawings. FIG. 1(*a*) and FIG. 1(*b*) show an example of a printing device 10 according to an embodiment of the disclosure. FIG. 1(*a*) and FIG. 1 (*b*) are a front view and a top view illustrating an example of the configuration of a main portion of the printing device 10. In the present embodiment, the printing device 10 is an inkjet printer which performs printing in an inkjet scheme, and includes a head unit 12, a main scan driver 14, a sub scan driver 16, a platen 18, ultraviolet-light irradiation units 20, and a controller 22. Also, the printing device 10 may have the same or similar configuration as or to that of a known inkjet printer, except for points to be described below. For example, the individual components described above may have the same or similar features as or to those of a known inkjet printer, except for points to be described below. Also, the printing device 10 may further include any other component which is the same as or similar to that of a known inkjet printer, besides the individual components described above.

Figure 1A:
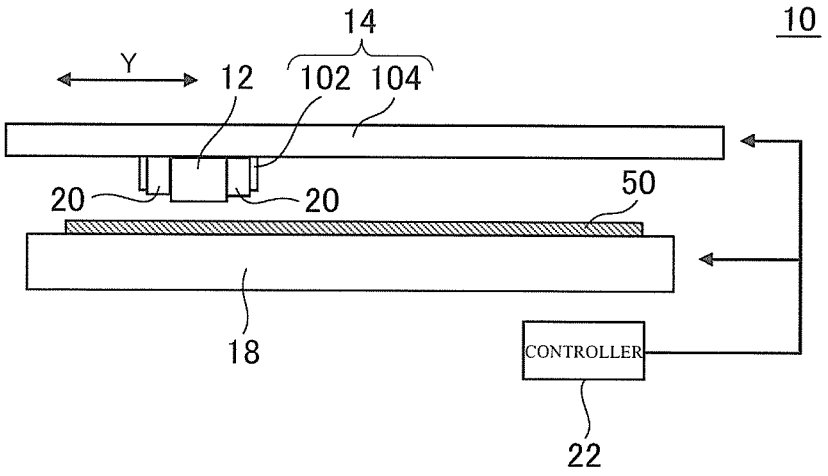
FIG. 1(*a*) and FIG. 1(*b*) are views illustrating an example of a printing device 10 according to an embodiment of the disclosure.

The head unit 12 is a part having a nozzle row in which a plurality of nozzles for ejecting ink drops is in line, and ejects ink drops onto a medium 50 which is a print target, thereby performing printing on the medium 50. Also, in the present embodiment, the head unit 12 ejects ink drops of ultraviolet curing ink from the individual nozzles of the nozzle row onto the medium 50. Also, a more specific configuration of the head unit 12 will be described below in detail.

The main scan driver 14 is a component for driving the head unit 12 to perform a main scan operation of ejecting ink drops while moving in a predetermined main scan direction (a Y direction in the drawings). In the present embodiment, the main scan driver 14 includes a carriage 102 and a guide rail 104. The carriage 102 holds the head unit 12 such that the nozzle row and the medium 50 face each other. The guide rail 104 is a rail for guiding movement of the carriage 102 along the main scan direction, and moves the carriage 102 along the main scan direction in response to an instruction of the controller 22. Also, in the present embodiment, the main scan driver 14 drives the head unit 12 to perform the main scan operation in each direction of an outward direction set in advance in the main scan direction and a homeward direction opposite to the outward direction.

The sub scan driver 16 is a component for making the head unit 12 perform a sub scan operation of relatively moving with respect to the medium 50 in a sub scan direction (an X direction in the drawings) perpendicular to the main scan direction. In the present embodiment, the sub scan driver 16 is a roller for conveying the medium 50, and conveys the medium 50 in the intervals between main scan operations, thereby making the head unit 12 perform a sub scan operation. In this case, more specifically, in each of an interval between a main scan operation which is performed while the head unit moves in the outward direction and a main scan operation which is performed while the head unit moves in the homeward direction, and an interval between a main scan operation which is performed while the head unit moves in the homeward direction and a main scan operation which is performed while the head unit moves in the outward direction, the sub scan driver 16 relatively moves the head unit 12 with respect to the medium 50 by a predetermined printing pass width.

The platen 18 is a board-like member for mounting the medium 50, and supports the medium 50 such that the medium faces the head unit 12. The ultraviolet-light irradiation units 20 are ultraviolet light sources for radiating ultraviolet light onto ink dots formed on the medium 50. As the ultraviolet-light irradiation units 20, for example, UV LEDs can be suitably used. Also, the ultraviolet-light irradiation units 20 are held together with the head unit 12 by the carriage 102, and move together with the head unit 12 during a main scan operation. Thereby the ultraviolet-light irradiation units 20 harden ink on the medium 50 during the main scan operation.

Also, in the present embodiment, the ultraviolet-light irradiation units 20 are installed on both sides of the head unit 12 in the main scan direction. Further, in a main scan operation which is performed while the head unit moves in each of the outward direction and the homeward direction, an ultraviolet-light irradiation unit 20 positioned on the rear side from the head unit 12 in the movement direction of the head unit 12 radiates ultraviolet light onto ink on the medium 50.

The controller 22 is, for example, a CPU of the printing device 10, and controls the operation of each unit of the printing device 10, for example, in response to instructions of a host PC. Thereby the controller 22 controls the head unit 12 such that the head unit performs a main scan operation, a sub scan operation, and the like.

Also, more specifically, in the present embodiment, the controller 22 controls the printing device 10 such that the printing device performs a printing operation in a multi-pass mode. Also, in the multi-pass mode printing operation, the controller performs setting of density of printing to be performed by individual printing passes. This density setting will be described below in more detail.

Also, the controller 22 performs, for example, the same as or similar operations as or to those of a controller of an inkjet printer according to the related art, except for points described above or to be described below. For example, the controller 22 may receive an image to be printed, from the host PC, and perform an image forming process such as an RIP process, and so on. Also, according to an image which is formed by an image forming process, the controller 22 determines, for example, an operation to be performed in each printing pass of the multi-pass mode.

Due to the above described configuration, according to the present embodiment, for example, it is possible to appropriately perform printing on individual areas of the medium 50 in the multi-pass mode. Also, in this case, by performing a sub scan operation after a main scan operation of each of an outward way and a homeward way, it is possible to form ink dots on the same area of the medium 50 in each of an outward way and a homeward way by the different nozzles of the head unit. Therefore, according to the present embodiment, it is possible to more appropriately uniformize the features of the nozzles and more appropriately perform printing with a high degree of accuracy.

Figure 2A:
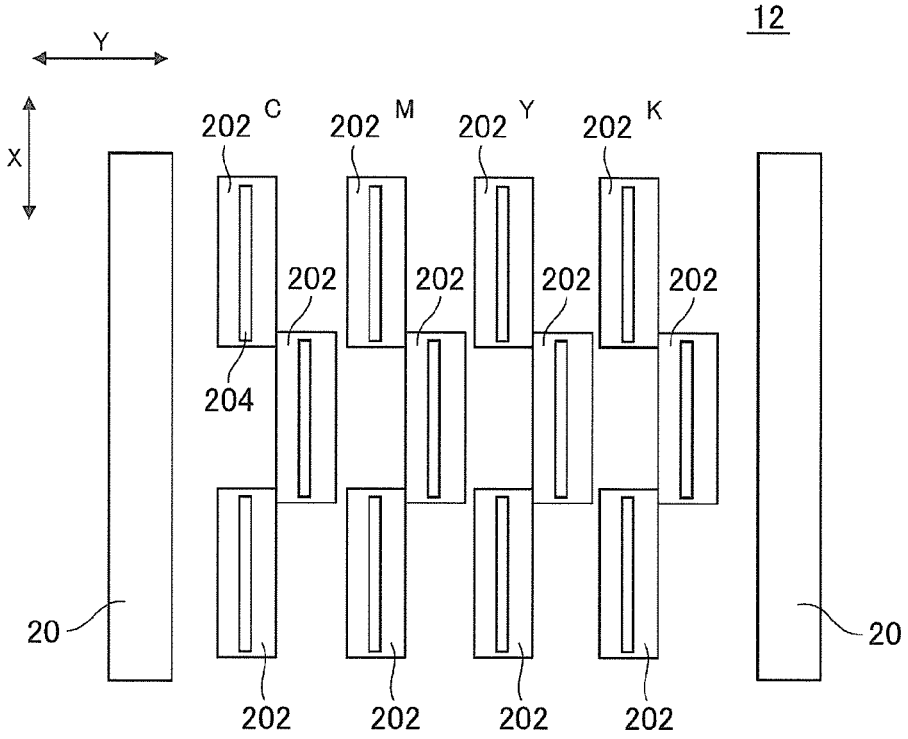
FIG. 2(*a*) and FIG. 2(*b*) are views illustrating an example of the configuration of a head unit 12.
Figure 2B:
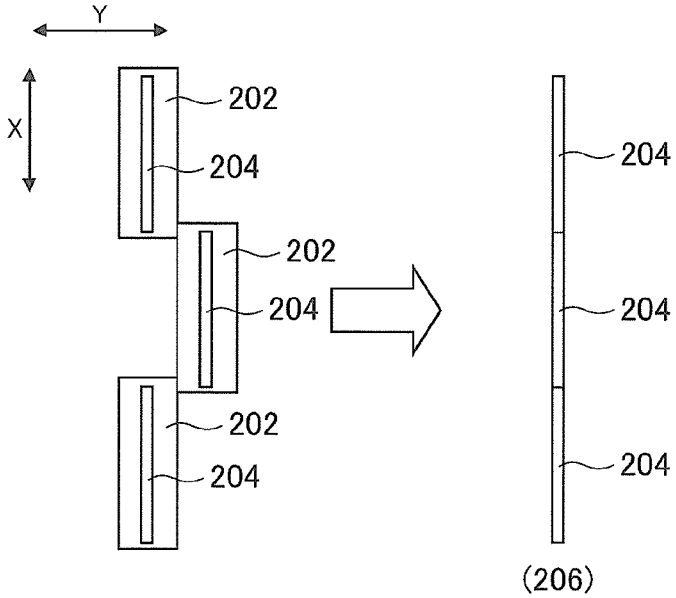

Next, a more specific configuration of the head unit 12 will be described in detail. FIG. 2(*a*) and FIG. 2(*b*) show an example of the configuration of the head unit 12. FIG. 2(*a*) shows an example of the overall configuration of the head unit 12 together with the ultraviolet-light irradiation units 20. FIG. 2(*b*) shows an example of the configuration of a plurality of inkjet heads 202 of the head unit 12 for ejecting ink drops of ink of the same color.

In the present embodiment, the head unit 12 is a head unit for color printing which ejects ink drops of a plurality of colors (colors of C, M, Y, and K), and has a plurality of inkjet heads 202 for each color between the ultraviolet-light irradiation units 20 positioned on one side and the other side in the main scan direction. Also, the plurality of inkjet heads 202 for each color is lined up in a staggered shape. To line up a plurality of inkjet heads 202 in a staggered shape means to line up the inkjet heads in the sub scan direction while being staggered in the main scan direction, for example, as shown in FIG. 2(*a*) and FIG. 2(*b*). Also, the inkjet heads 202 of different colors are installed side by side in the main scan direction such that their positions in the sub scan direction are aligned with corresponding inkjet heads 202 of the other colors as shown in FIG. 2(*a*) and FIG. 2(*b*). Also, arrangement of the inkjet heads 202 of each color may be, for example, a color stagger arrangement.

Also, in the present embodiment, each of the individual inkjet heads 202 has a nozzle row 204 in which nozzles are in line along the sub scan direction. In this case, for example, as shown in FIG. 2(*b*), the nozzle rows 204 of the plurality of inkjet heads 202 for the same color are lined up along the sub scan direction while being staggered in the main scan direction according to the positions of the inkjet heads 202. Therefore, in a case of seeing only the positions of the individual nozzle rows 204 in the sub scan direction, it is also considered that they are in a straight line as shown on the right side in FIG. 2(*b*). Also, in this case, it is possible to consider a nozzle row 206 which is obtained by virtually connecting the nozzle rows 204 of the plurality of inkjet heads 202 for the same color in the sub scan direction, and consider the corresponding nozzle row 206 as a nozzle row of the head unit 12. For this reason, nozzle rows 206 which are obtained by virtually connecting the nozzle rows 204 in the sub scan direction hereinafter will be referred to as nozzle rows 206 of the head unit 12.

Also, in FIG. 2(*a*) and FIG. 2(*b*), for convenience of explanation, a configuration in a case which three inkjet heads 202 are provided for each color of C, M, Y, and K is shown. However, the number of inkjet heads 202 for each color may be a number other than 3. For example, the number of inkjet heads 202 for each color may be one. Also, the head unit 12 may further include one or more inkjet heads 202 for each of other colors. For example, the head unit 12 may further include inkjet heads 202 for some or all of individual colors such as W (white), CL (clear), and PR (primer), in addition to the individual colors of C, M, Y, and K.

Next, setting of printing density of individual printing passes for an operation of performing printing in the multi-pass mode will be described. In the present embodiment, the printing device 10 performs a main scan operation corresponding to each of a predetermined N-number of printing passes (wherein N is an integer of three or greater) on the same area of the medium 50 (see FIG. 1(*a*) and FIG. 1(*b*)). In this case, a plurality of nozzles 208 which is in line from the head front end side toward the head rear end side in each nozzle row 206 of the head unit 12 (see FIG. 1(*a*) and FIG. 1(*b*)) become nozzles 208 for ejecting ink drops corresponding to the individual printing passes, respectively. Also, in this case, the head rear end side means a direction in the head unit from a nozzle for ejecting ink drops corresponding to a first printing pass toward a nozzle for ejecting ink drops corresponding to an N-th printing pass. Also, the head front end side means the opposite side to the head rear end side.

Figure 3:
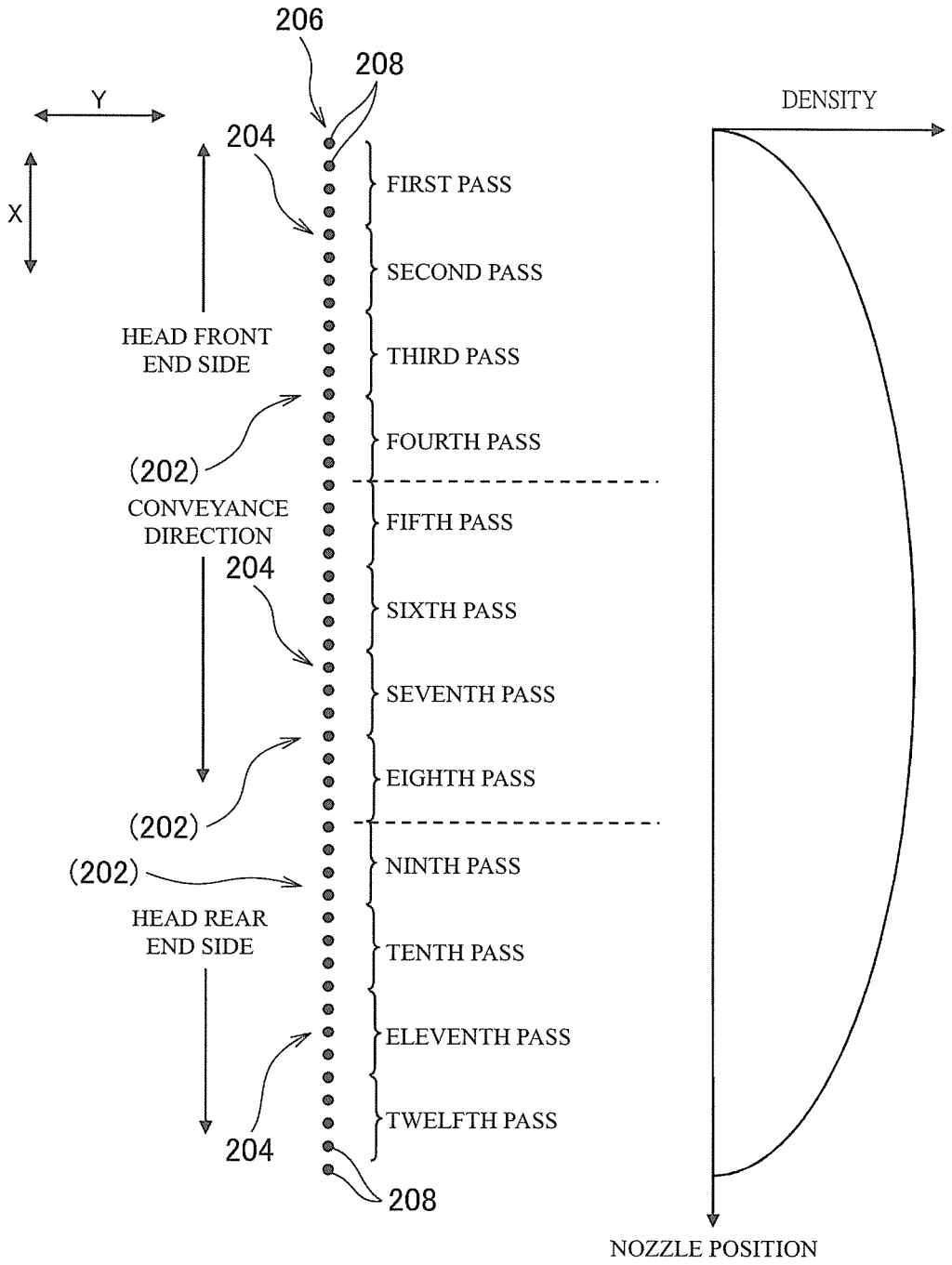
FIG. 3 is a view illustrating an example of setting of printing density of individual printing passes.

FIG. 3 shows an example of setting of printing density of the individual printing passes. In the case shown in FIG. 3, the printing device 10 performs printing by twelve printing passes. Further, in this case, the nozzles 208 of each nozzle row 206 of the head unit 12 from the head front end side toward the head rear end side are assigned for the individual printing passes of the first pass to the twelfth pass, as shown in FIG. 3.

Also, as described with reference to FIG. 2(*a*) and FIG. 2(*b*), in the present embodiment, each nozzle row 206 of the head unit 12 consists of the nozzle rows 204 of three inkjet heads 202. Therefore, in this case, more specifically, the nozzles of the nozzle row 204 of the first inkjet head 202 from the head front end side are assigned for individual printing passes of the first pass to the fourth pass. Also, the nozzles of the nozzle row 204 of the second inkjet head 202 from the head front end side are assigned for individual printing passes of the fifth pass to the eighth pass. Further, the nozzles of the nozzle row 204 of the first inkjet head 202 from the head rear end side are assigned for individual printing passes of the ninth pass to the twelfth pass.

Also, in FIG. 3, for convenience of illustration, with respect to arrangement of the nozzles 208, simplification such as a reduction in the number of nozzles 208 corresponding to one printing pass has been appropriately performed. In an actual configuration, a plurality of nozzles 208 constituting the nozzle row 204 of each inkjet head 202 is arranged, for example, at a pitch of a resolution of 300 dpi along the sub scan direction. Also, in a multi-pass mode printing operation, the sub scan driver 16 may use, for example, a feed amount for shifting by a distance less than the pitch of the nozzles 208, as the feed amount of the medium 50 in each sub scan operation. More specifically, for example, it can be considered to set the feed amount of the medium 50 in each sub scan operation such that a shift of half of the pitch of the nozzles 208 occurs. In this case, the resolution of printing in the sub scan direction becomes 600 dpi which is twice the resolution corresponding to the pitch of the nozzles 208. Also, it can be considered to set the feed amount of the medium 50 in each sub scan operation such that a shift of one-third of the pitch of the nozzles 208 occurs. In this case, the resolution of printing in the sub scan direction becomes 900 dpi which is three times the resolution corresponding to the pitch of the nozzles 208.

Figure 1B:
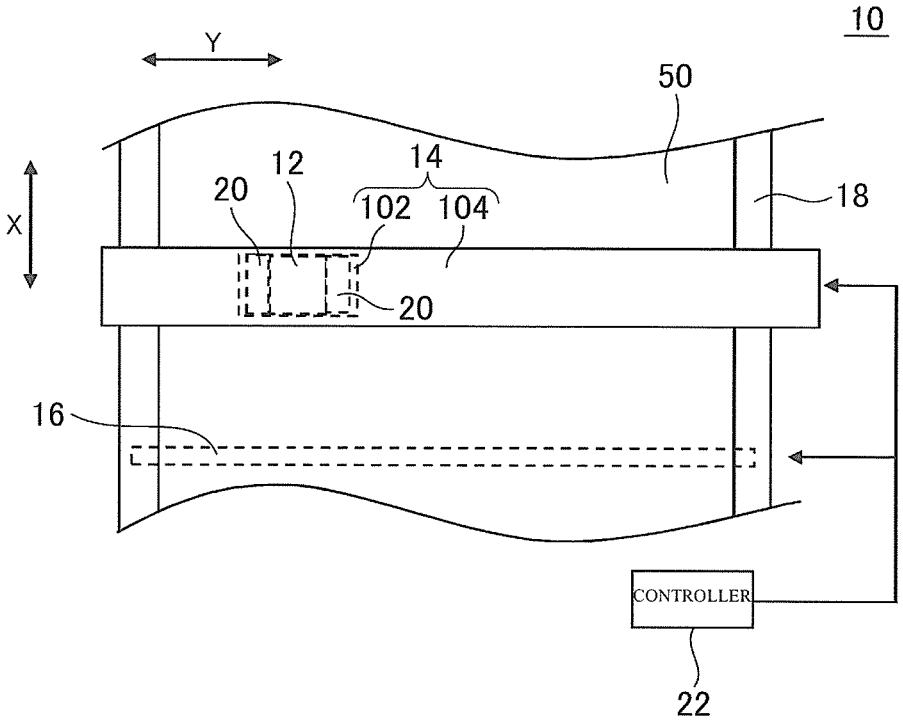

In the present embodiment, the controller 22 (see FIG. 1(*a*) and FIG. 1(*b*)) sets at least the density of printing to be performed in a k-number of last printing passes (wherein k is a predetermined integer which is equal to or greater than 1 and is less than N) of an N-number of printing passes to be performed on the same area of the medium, such that the corresponding density are lower than the density of printing to be performed in the (N−k)-th printing pass. In this case, the density of printing to be performed in each printing pass mean density corresponding to the density of ink dots to be formed, for example, in a band area of a printing pass width, in the corresponding printing pass. Also, the density corresponding to the density of ink dots may be, for example, density appropriately standardized according to the density of ink dots.

Further, the controller 22 sets the density of printing to be performed by a plurality of individual nozzles of each nozzle row 206 of the head unit 12 for ejecting ink drops in the (N−k+1)-th printing pass, such that the density gradually decrease toward the head rear end side. In this case, the density of printing to be performed by the plurality of individual nozzles mean, for example, density corresponding to the density of ink dots to be formed by the corresponding nozzles in one main scan operation. Also, in this case, the density of ink dots is an ink arrangement density in the main scan direction.

Also, more specifically, the controller 22 performs setting of density corresponding to the individual printing passes, for example, as shown in the right portion of FIG. 3. Thereby the controller 22 sets the density of printing to be performed in the twelfth printing pass which is the last pass, for example, so as to be lower than the density of printing to be performed in the eleventh printing pass which is the second last printing pass. Also, the controller 22 sets at least the density of printing to be performed by the plurality of individual nozzles of each nozzle row 206 of the head unit 12 for ejecting ink drops corresponding to the last printing pass, so as to gradually decrease toward the head rear end side.

According to this configuration, for example, by setting the density of printing for the last printing pass or the like so as to be low, it is possible to reduce, for example, the density of ink dots to be formed in a surface layer part of an ink layer, thereby making it difficult for dot connection and the like to occur. Also, by this, it is possible to appropriately uniformize the shapes of ink dots in the surface layer part of the ink layer. Therefore, according to the present embodiment, it is possible to appropriately suppress occurrence of strip patterns and the like, for example, in a case of performing printing in the multi-pass mode using ultraviolet curing ink.

Also, in this case, with respect to a printing pass for which printing density are set to be lower than those of the previous printing pass, the density of the whole printing pass are not set to be uniformly low, but the density to be performed by a plurality of individual nozzles for ejecting ink drops in the corresponding printing pass are set so as to gradually decrease toward the head rear end side. Therefore, the printing densities do not significantly change in a step manner in units of a printing pass. Therefore, according to the present embodiment, for example, it is possible to appropriately prevent the boundaries between the printing passes from becoming conspicuous.

Also, in the present embodiment, more specifically, the controller 22 sets the density of printing to be performed by the plurality of individual nozzles 208 of each nozzle row 206 of the head unit 12, such that, with respect to the central portion of the nozzle row 206 in the sub scan direction, the manner of density variation in a direction toward the head front end side becomes symmetrical to that in a direction toward the head rear end side. For example, the controller 22 sets the density of printing to be performed by the nozzles 208 of the central portion of each nozzle row 206 in the sub scan direction so as to be highest as shown in the right portion of FIG. 3, such that the density of printing to be performed by the nozzles 208 of the central portion are higher than the density of printing to be performed by the nozzles 208 of the ends of the nozzle row 206. Also, the controller sets the density of printing to be performed by the plurality of individual nozzles 208, so as to gradually decrease as the distance from the central portion increases.

According to this configuration, it is possible to appropriately set low density as the printing density of the last printing pass and the like. Also, by this, for example, it is possible to more appropriately uniformize the shapes of ink dots in the surface layer part of the ink layer.

Here, in a case of performing printing in the multi-pass mode, it is required to adjust the total density of printing density of the individual printing passes to a predetermined density. For this reason, for example, in a case where the density of any printing pass has been decreased, it is required to increase the density of other printing passes as much as the decrease.

Also, in a case where density setting is not performed only in units of a printing pass, but is performed in units of a nozzle as in the present embodiment such that the density of printing to be performed by a plurality of nozzles for ejecting ink drops in one printing pass gradually change, it is required to set the density of other printing passes such that the corresponding change is complemented. However, this density setting for performing such complementation is not always easy, and may be complicated.

In contrast to this, in the present embodiment, for example, by making the manner of density variation have symmetry, it is possible to appropriately complement the density of printing to be performed by the individual nozzle 208 between the head rear end side and the head front end side. Also, by this, it is possible to appropriately decrease the printing density of the last printing pass or the like. Therefore, according to the present embodiment, it is possible to more appropriately uniformize the shapes of ink dots, for example, in the surface layer part of the ink layer.

Also, in the present embodiment, not only with respect to the last printing pass but also with respect to each printing pass for performing printing by nozzles 208 on the head rear end side from the central portion of the nozzle row 206, the density is set so as to be lower than that of the previous printing pass, for example, as shown in the right portion of FIG. 3. Therefore, more specifically, not only with respect to the last printing pass, but also with respect to other printing passes such as the eleventh printing pass which is the second last past process, density are set so as to be lower than those of the previous printing passes such as the tenth printing pass. Further, in this case, for example, even with respect to ink dots to be formed by the second last printing pass or the like, for example, by decreasing the density, it is possible to make it difficult for dot connection and the like to occur. Also, by this, it is possible to more appropriately uniformize the shapes of ink dots, for example, in the surface layer part of the ink layer.

Also, in the above description, the density of printing to be performed in each printing pass and the density of printing to be performed by the plurality of individual nozzles 208 may be more specifically density in a case of filling the medium with a density set in advance in the printing device. This density may be, for example, a density of 100% set in advance in the printing device. Also, this density may be a density which is defined, for example, as 200% or 300%, according to setting of the printing device.

Also, to set the density of printing to be performed by the plurality of individual nozzles 208 for ejecting ink drops in a printing pass such as the last printing pass so as to gradually decrease toward the head rear end side means, for example, to set the printing density corresponding to the individual nozzles such that the density decrease as the nozzles go toward the head rear end side. In this case, the density of all nozzles are not always set to be different, and the density of some nozzles may be set so as to be the same as those of adjacent nozzles. For example, the density of printing to be performed by the individual nozzles may be gradually changed in units of a predetermined number of nozzles. In this case, the printing density may change, for example, stepwise. Even in this case, it is possible to make the density change appropriately and sufficiently slowly, for example, as compared to a case of changing the density stepwise in units of a printing pass. Also, by this, it is possible to appropriately prevent the boundaries between the printing passes from becoming conspicuous. Also, the density of printing to be performed by the individual nozzles may be gradually changed, more finely, in units of one nozzle. According to this configuration, for example, it is possible to more appropriately prevent the boundaries between the printing passes from becoming conspicuous.

Also, in a case of setting the density of printing to be performed by the individual nozzles 208 in the last printing pass or the like, so as to be low, the positions of a plurality of ink dots to be formed on the same line in the sub scan direction are distributed on the basis of a certain rule which is determined, for example, by a dither method or an error diffusion method. According to this configuration, for example, with respect to nozzles 208 to perform printing at low density, it is possible to appropriately distribute the positions of dots to be formed.

Figure 4A:
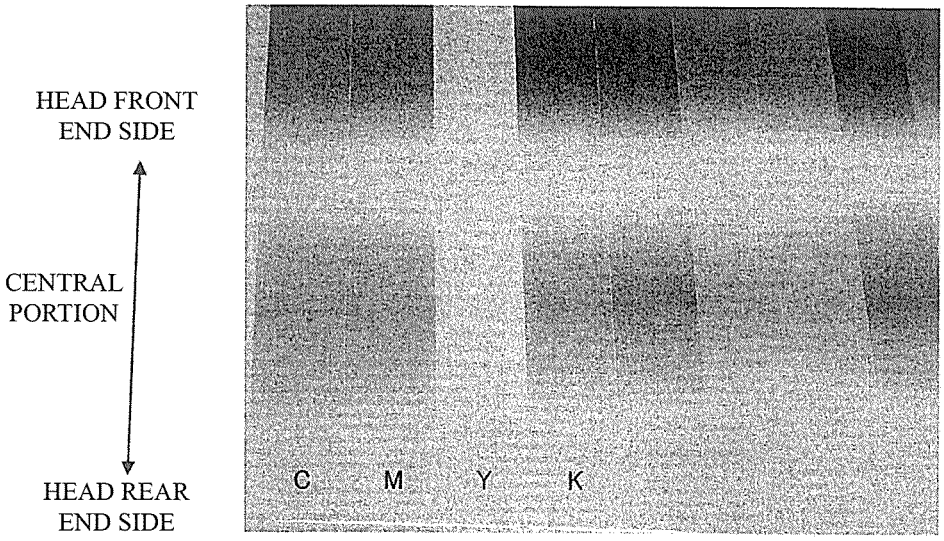
FIG. 4(*a*) and FIG. 4(*b*) are views illustrating a result of printing performed using the density setting of the embodiment.
Figure 4B:
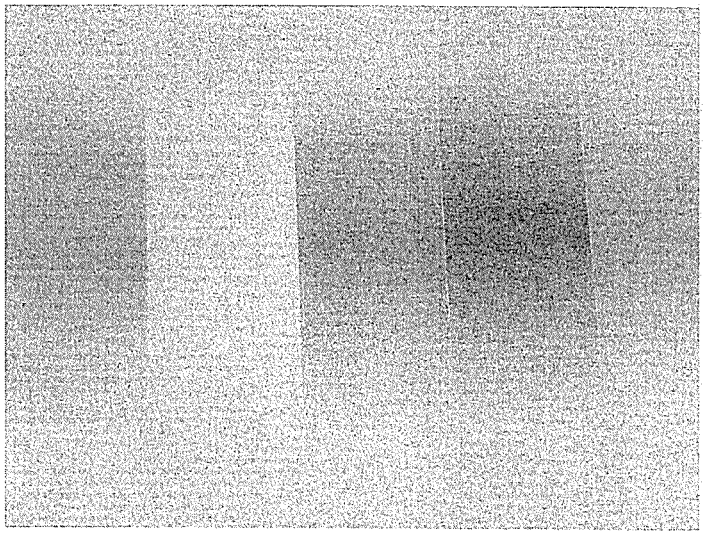

FIG. 4(*a*) and FIG. 4(*b*) are views illustrating a result of printing performed using the density setting of the present embodiment, and shows an appearance obtained by performing one main scan operation while subsequently ejecting ink drops of ink of different colors (such as the individual colors C, M, Y, and K) used in the printing device 10, with respect to the case of using the density setting shown in FIG. 3. FIG. 4(*a*) is a photo illustrating an example of the print result attributable to one main scan operation. FIG. 4(*b*) is an enlarged photo of a portion of the print result.

As seen from both photos, in a case of performing a main scan operation using the density setting as described with reference to FIG. 3, the density of a portion printed by the nozzles of the central portion of the head unit 12 is high, and the density of portions of printed by the nozzles of the head front end side and the head rear end side are low. Also, in this case, in an actual printing operation, by alternately performing a plurality of main scan operations and sub scan operations, it is possible to appropriately set low density as the printing density of the last printing pass and the like as described above. Also, by this, it is possible to more appropriately uniformize the shapes of ink dots, for example, in the surface layer part of the ink layer.

Also, in a case of using ink of a plurality of colors (such as individual colors of C, M, Y, and K) like in the present embodiment, the inclination or the like of the density setting may be set to differ depending on the colors. According to this configuration, it is possible to perform printing with a higher degree of accuracy, for example, according to the features of ink of the individual colors.

Figure 5A:
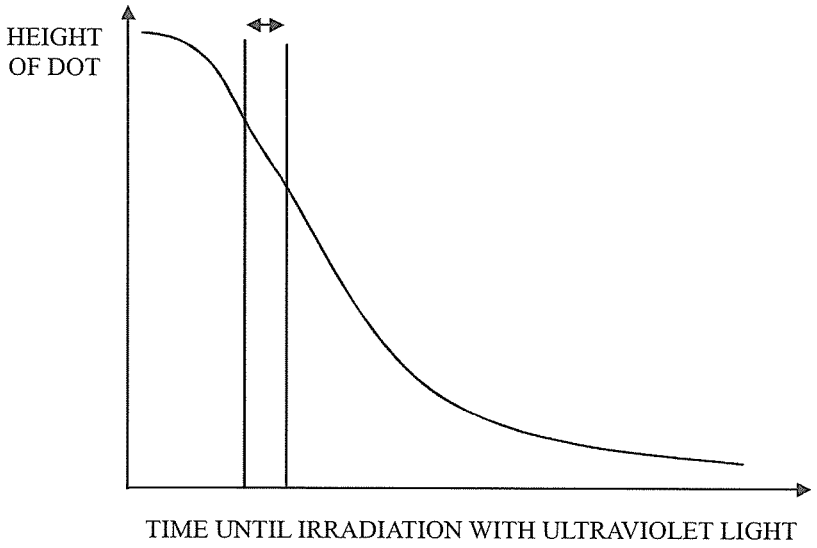
FIG. 5(*a*)~FIG. 5(*c*) are views for explaining an ink-dot hardening method.
Figure 5B:
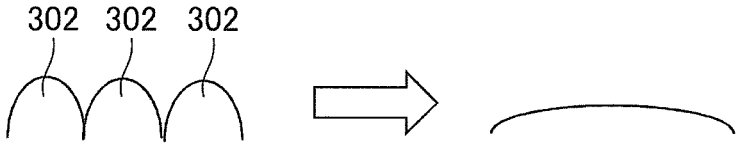
Figure 5C:
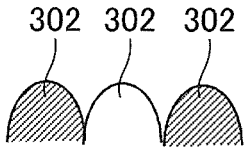

Now, how ink dots harden in the present embodiment will be described in more detail. FIG. 5(*a*)~FIG. 5(*c*) are views for explaining an ink-dot hardening method. FIG. 5(*a*) is a graph illustrating an example of the relation between time from when an ink drop lands on a medium to when the ink drop is irradiated with ultraviolet light, and the height of an ink dot after hardening.

In a state before irradiation with ultraviolet light, the ultraviolet curing ink has low viscosity such that it can be ejected from the nozzles. Therefore, ink dots which are formed by landing of ink drops on the medium gradually spread as time passes. Also, this dot spreading finishes if the ink is sufficiently hardened by irradiation with ultraviolet light. Therefore, as shown by the graph, the relation between time until irradiation with ultraviolet light and the height of an ink dot after hardening becomes a relation in which the height of the ink dot after hardening decreases as the time until irradiation with ultraviolet light lengthens. Also, as shown by the graph, the inclination of the change of the height of the dot relative to the time until irradiation with ultraviolet light is generally steep in a period to a certain time.

Here, as described with reference to FIG. 2(*a*) and FIG. 2(*b*) and the like, in the present embodiment, the head unit 12 (see FIG. 2(*a*) and FIG. 2(*b*)) has a configuration in which the inkjet heads 202 (see FIG. 2(*a*) and FIG. 2(*b*)) of the plurality of colors are in line in the main scan direction. Also, the ultraviolet-light irradiation units 20 are installed on both sides of the head unit 12 in the main scan direction. Further, ink on the medium 50 is irradiated with ultraviolet light by an ultraviolet-light irradiation unit 20 which is positioned on the rear side of the head unit 12 in a main scan operation of each direction of the outward direction and the homeward direction of the main scan direction.

However, as can seen from the configuration shown in FIG. 2(*a*) and FIG. 2(*b*) and the like, inkjet heads 202 of each color are not always at positions equidistant from the two ultraviolet-light irradiation units 20. Also, even in a case of considering a configuration other than that shown in FIG. 2(*a*) and FIG. 2(*b*), in a case of using inkjet heads of a plurality of colors, with respect to at least one color, generally, inkjet heads are installed at positions distant by different distances from the two ultraviolet-light irradiation units 20.

Further, in these cases, the time until irradiation with ultraviolet light differs between a main scan operation of the outward direction and a main scan operation of the homeward direction. Also, in the printing device, in a case of performing printing at a printing speed required in recent years, in general, it is required to perform irradiation with ultraviolet light in a period when change of the heights of dots is relatively sensitive to time as shown by an arrow in the graph. Therefore, in a case of performing main scan operations in both of the outward and homeward directions, in general, between a main scan operation in the outward direction and a main scan operation in the homeward direction, differences in the heights of ink dots after hardening easily occur. Also, as a result, in a case of performing printing in the multi-pass mode using ultraviolet curing ink, according to the directions in which main scan operations are performed, differences between the print results of the individual printing passes may occur. More specifically, for example, it can be considered that, according to the directions in which main scan operations are performed, mat print results with a high degree of surface roughness and glossy print results with a low degree of surface roughness appear alternately. Further, it is considered that these phenomena become one of the causes of occurrence of strip patterns, for example, in a case of performing printing by a method according to the related art.

In contrast to this, in the present embodiment, as described in association with FIG. 3, with respect to the last printing pass and the previous printing pass thereof, low densities are set. Therefore, in the present embodiment, it is possible to appropriately reduce the number of ink dots to be performed by the last reciprocation of a plurality of main scan operations. Also, by this, it is possible to appropriately suppress the influence of the directions of main scan operations on the surface layer part of the ink layer.

Also, as described above, in the present embodiment, by setting the printing density of the last printing pass and the like so as to be low, with respect to ink dots to be formed in the surface layer part of the ink layer, for example, the density is decreased, and occurrence of dot connection and the like is made difficult. Also, by this, with respect to the surface layer part of the ink layer, the shapes of ink dots are uniformized. Now, these effects will be described more specifically in association with the ink-dot hardening method.

FIG. 5(*b*) shows an example of how ink dots are connected. In a case of forming a plurality of ink dots 302 at close positions such as adjacent pixels in the first printing pass, the liquid dots 302 easily come into contact with each other. Further, if this contact occurs, the ink dots are connected, thereby forming one large dot as shown on the right side of FIG. 5(*b*). Also, in this case, since the contact angle of the medium and the ink increases, the ink dot easily spreads, whereby the ink dot flattens within a shorter time. Also, for example, in a case where the printing density of a printing pass are high, since the number of dots which should be formed is large, it becomes easy for dot connection as described above to occur. Further, as a result, between portions where connection has occurred and portions where connection has not occurred, differences in the shapes and heights of ink dots easily occur.

Meanwhile, for example, in a case where the printing density are low like in the last printing pass of the present embodiment, since it is possible to discretely form ink dots, it is difficult for connection of ink dots to occur. Also, in the last printing pass or the like, as shown in FIG. 5(*c*), around an area where ink dots should be formed, already hardened ink dots have been formed by the previous printing pass. FIG. 5(*c*) shows an example of the appearance of ink dots which are formed in the last printing pass or the like.

In this case, since the ink dots are surrounded by hardened dots 302, even in an unhardened liquid state, areas where ink dots 302 can spread are limited. Also, since the contact angle of the medium and the ink decreases, it is difficult for flattening to occur. Therefore, in this case, even if there are slight differences in the time until irradiation with ultraviolet light, it is difficult for differences in the heights of ink dots after hardening to occur. More specifically, it can be considered that, for example, even if a difference in the time until irradiation with ultraviolet light between a main scan operation in the outward direction and a main scan operation in the homeward direction occurs due to the structure of the head unit 12, it becomes difficult for differences in the heights of ink dots to be formed to occur. Therefore, according to the present embodiment, for example, even in a case of performing main scan operations while moving the head unit in both directions of the outward direction and the homeward direction, with respect to ink dots to be formed in the surface layer part of the ink layer, it is possible to appropriately suppress differences in the heights of the dots according to the directions of the main scan operations. Also, by this, it is possible to more appropriately suppress the influence of the directions of the main scan operations.

Figure 6A:
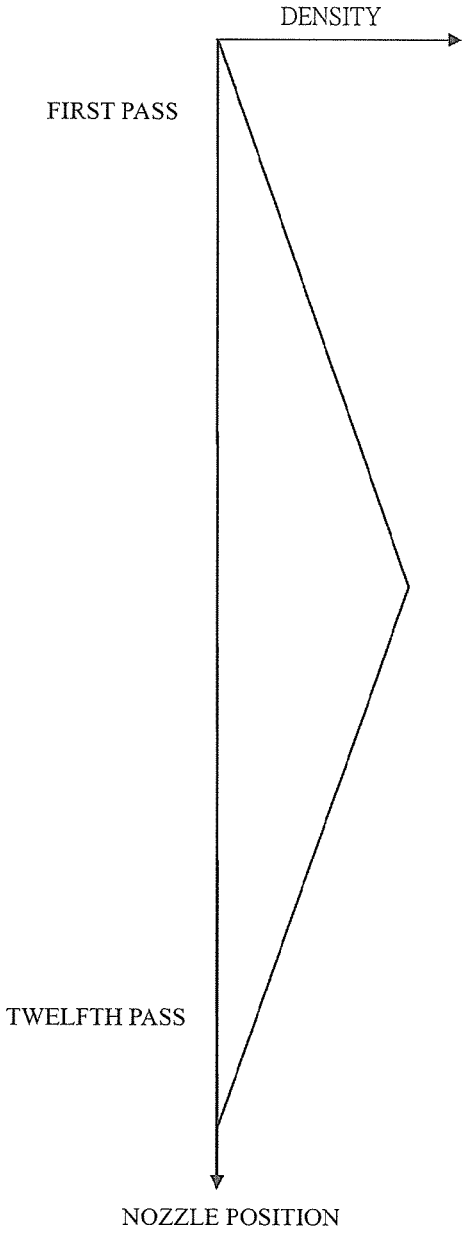
FIG. 6(*a*) and FIG. 6(*b*) are views illustrating modifications of density setting.
Figure 6B:
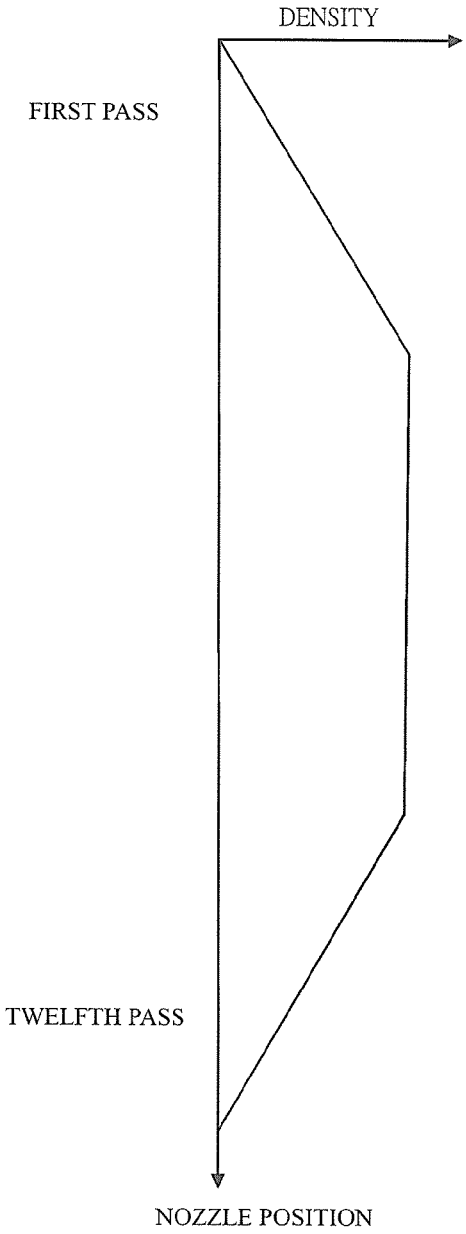

Next, with respect to density setting which is performed in the present embodiment, modifications other than the configuration described with reference to FIG. 3 will be described. FIG. 6(*a*) and FIG. 6(*b*) are views illustrating modifications of density setting, and shows density setting examples of modifications of density setting shown on the right side of FIG. 3. FIG. 6(*a*) shows a first modification of density setting. FIG. 6(*b*) shows a second modification of density setting.

In FIG. 3, with respect to the density of printing to be performed by the plurality of individual nozzles of each nozzle row 206 (see FIG. 2(*a*) and FIG. 2(*b*)) of the head unit 12, an example of a case where the density gradually vary in a curved shape is shown. However, variation in the density may be linearly set as shown in FIG. 6(*a*). Also, variation in the density may be set such that the density of a partial range such as the central portion of each nozzle row 206 are constant, for example, as shown in FIG. 6(*b*). Even in these cases, similarly in the case of density setting shown in FIG. 3, it is possible to appropriately set low density as the printing density for the last printing pass or the like. Also, by this, it is possible to more appropriately uniformize the shapes of ink dots, for example, in the surface layer part of the ink layer. Further, it is possible to similarly achieve even the other effects.

Figure 7:
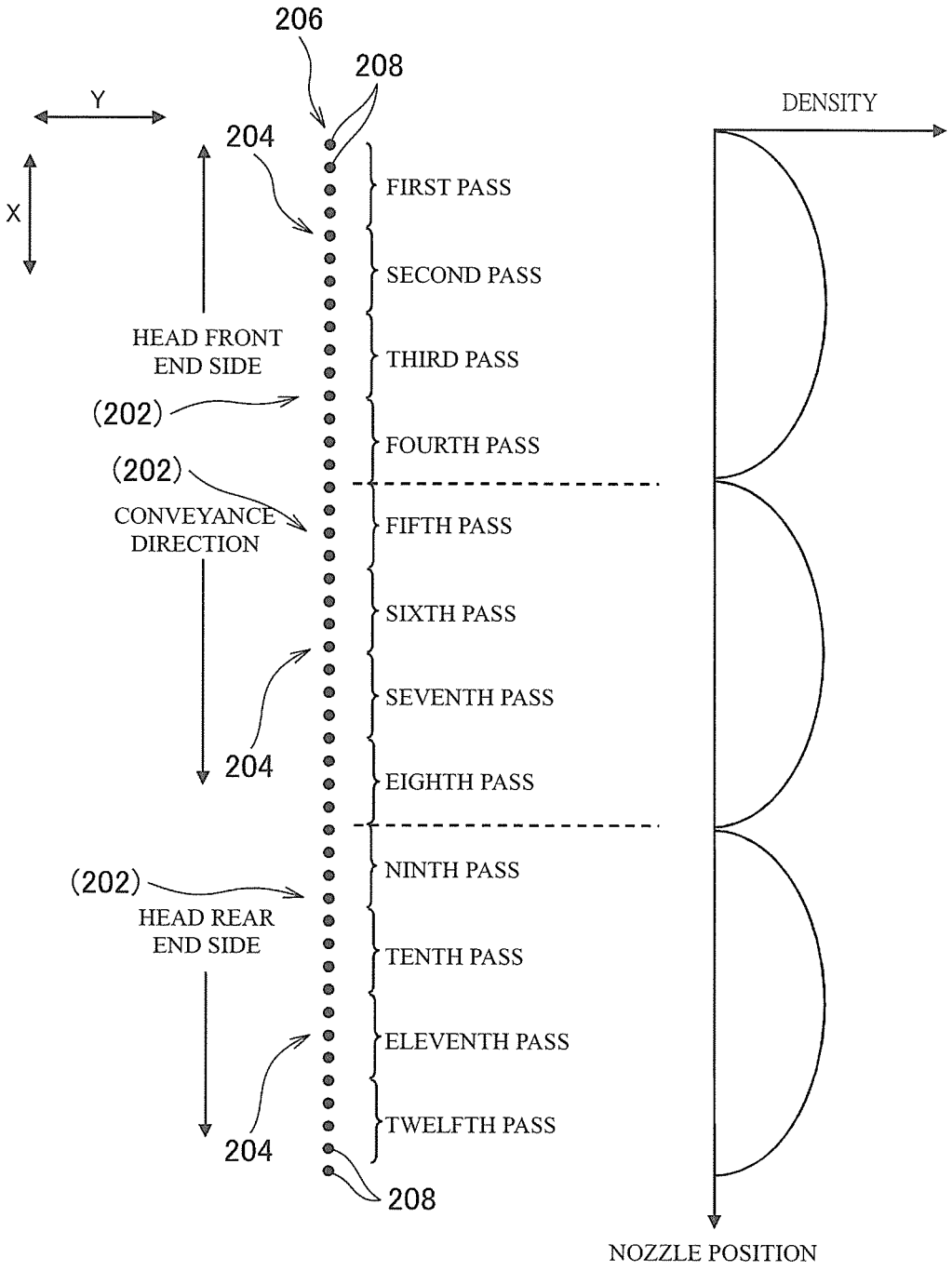
FIG. 7 is a view illustrating another modification (a third modification) of density setting.

Also, in a case of using a plurality of inkjet heads 202 (see FIG. 2(*a*) and FIG. 2(*b*)) with respect to the same color like in the present embodiment, it can also be considered to set the density of each printing pass not only according to the nozzle rows 206 of the whole head unit 12 but also according to the nozzle rows 204 (see FIG. 2(*a*) and FIG. 2(*b*)) of the individual inkjet heads 202. FIG. 7 is a view illustrating another modification (hereinafter, referred to as the third modification) of density setting, and shows a density setting example of a modification of density setting shown on the right side of FIG. 3. Also, in FIG. 7, components denoted by the same reference symbols as those of FIG. 3 and the like have the same or similar features as or to those of the components of FIG. 3 and the like except for a point described below.

In the third modification, the controller 22 (see FIG. 1(*a*) and FIG. 1(*b*)) sets the density of printing to be performed by the plurality of nozzles 208 included in the nozzle rows 204 of the plurality of individual inkjet heads 202 for the same color lined up in a staggered shape, such that the density of printing to be performed by the nozzles of the central portion of the nozzle row 204 in the sub scan direction are high and the density gradually decrease as the distance from the central portion increases, as shown in FIG. 7. Even in this configuration, for example, with respect to the printing density of the last printing pass or the like, it is possible to appropriately set low density. Also, by this, it is possible to more appropriately uniformize the shapes of ink dots, for example, in the surface layer part of the ink layer. Further, it is possible to achieve even the other effects similarly in the case of using density setting shown in FIG. 3.

Also, in each inkjet head 202, deviations in landing positions and the like more easily occur by nozzles 208 of the ends of the nozzle row 204 than by nozzles 208 of the central portion. In contrast to this, in the configuration like the third modification, in each of the inkjet heads 202 lined up in a staggered shape, with respect to the printing density of nozzles 208 of the ends of the nozzle row 204, the density of printing to be performed by the corresponding nozzles 208 are set so as to be low. Therefore, for example, with respect to the individual inkjet head 202, it is possible to appropriately reduce the influence of the nozzles 208 of the ends of the nozzle rows 204. Also, by this, for example, even in a case where deviations of landing positions and the like occur in the nozzles 208 of the ends of the nozzle rows 204, it is possible to appropriately suppress their influence on print results. Therefore, according to this configuration, it is possible to appropriately set the density of each printing pass, for example, according to the configuration of the plurality of inkjet heads 202 lined up in a staggered shape.

Figure 8:
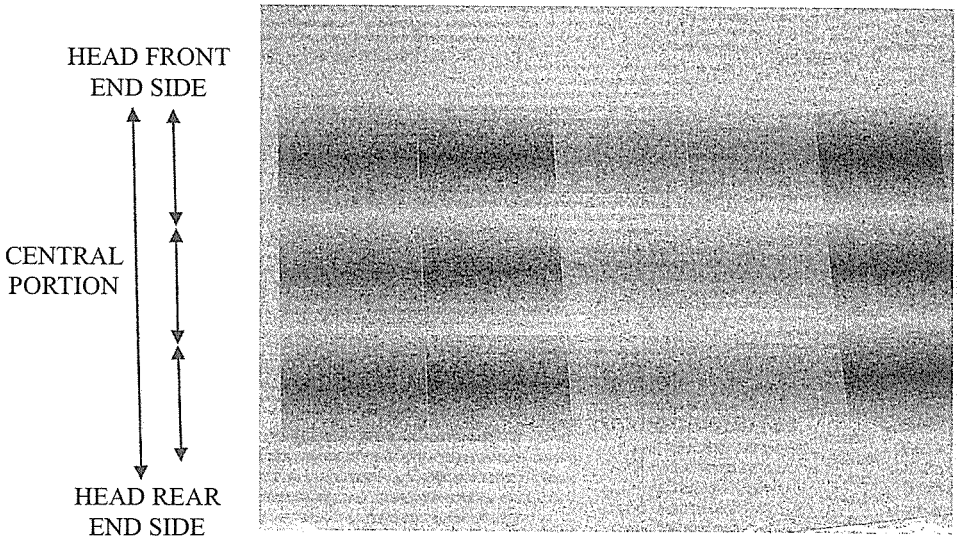
FIG. 8 is a view illustrating a result of printing performed using the density setting of the third modification.

FIG. 8 is a view illustrating a result of printing performed using the density setting of the third modification, and shows a photo of an example of a print result of one main scan operation. As can be seen from the photo, in a case of performing a main scan operation using the density setting as described with reference to FIG. 7, the density of portions printed by nozzles of the central portions of the nozzle rows 204 (see FIG. 7) of the individual inkjet heads 202 become high, and the density of portions printed by nozzles of the head front end sides and head rear end sides of the individual inkjet heads 202 become low. As a result, the density of portions printed by nozzles of the head front end sides and head rear end sides of the nozzle rows 206 (see FIG. 7) of the whole head unit 12 become low. Therefore, even in this case, as described above, it is possible to appropriately set low density as the printing density of, for example, the last printing pass and the like. Also, by this, it is possible to more appropriately uniformize the shapes of ink dots, for example, in the surface layer part of the ink layer.

Also, even in a case of setting the density of the individual printing passes according to the nozzle rows 204 of the individual inkjet heads 202, for example, density setting other than the configuration shown in FIG. 7 may be used. For example, with respect to the printing density of ranges where printing is performed by the nozzle rows 204 of the individual inkjet heads 202, the density may be set so as to vary linearly similarly in the density setting described with reference to FIG. 6(*a*). Also, it can be considered to set the density such that the density of partial ranges such as the central portions of the nozzle rows 204 of the individual inkjet heads 202 are constant similarly in the density setting described with reference to FIG. 6(*b*). Even in these cases, it is possible to appropriately set the density of each printing pass according to the configuration of the plurality of inkjet heads 202 lined up in a staggered shape.

Although the disclosure has been described above by way of the embodiment, the technical scope of the disclosure is not limited to the scope described in the embodiment. It is apparent to those skilled in the art that it is possible to make various changes or modifications in the above described embodiment. It is apparent from a description of claims that forms obtained by making such changes or modifications can also be included in the technical scope of the disclosure.

INDUSTRIAL APPLICABILITY

The disclosure can be suitably used, for example, in printing devices.

The invention claimed is:

1. A printing device which performs printing in an inkjet scheme, comprising:

a head unit, including a nozzle row in which a plurality of nozzles for ejecting ink drops of ultraviolet curing ink onto a medium is lined up;

a main scan driver, driving the head unit to perform a main scan operation of ejecting ink drops while moving along a main scan direction which is predetermined;

a sub scan driver, relatively moving the head unit with respect to the medium along a sub scan direction perpendicular to the main scan direction; and a controller, controlling the main scan operation of the head unit, wherein, in the nozzle row of the head unit, the plurality of nozzles is lined up along the sub scan direction, the head unit performs printing on the medium in a multi-pass mode for performing multiple times of the main scan operation on a same area of the medium, and performs the main scan operation corresponding to each of a predetermined N-number of printing passes on the same area of the medium, wherein N is an integer of three or greater, the controller sets at least a density of printing to be performed in a k-number of last printing passes of the N-number of printing passes to be performed on the same area of the medium, so as to be lower than a density of printing to be performed in the (N−k)-th printing pass, wherein k is an integer which is equal to or greater than 1 and is less than N and in a case where a direction from a nozzle of the nozzle row of the head unit for ejecting ink drops in a first printing pass of the N-number of printing passes toward a nozzle for ejecting ink drops in a N-th printing pass is referred to as a head rear end side, the controller sets a density of printing to be performed by a plurality of individual nozzles of the nozzle row of the head unit for ejecting ink drops in the (N−k+1)-th printing pass, so as to gradually decrease toward the head rear end side.

2. The printing device according to claim 1, wherein the controller sets at least a density of printing to be performed in the last one printing pass of the N-number of printing passes to be performed on the same area of the medium, so as to be lower than a density of printing to be performed in the (N−1)-th printing pass, and the controller sets a density of printing to be performed by the plurality of nozzles of the nozzle row of the head unit for ejecting ink drops in the last one printing pass, so as to gradually decrease toward the head rear end side.

3. The printing device according to claim 1, wherein the main scan driver drives the head unit to perform the main scan operation in each direction of an outward direction which is predetermined in the main scan direction, and a homeward direction opposite to the outward direction, and the sub scan driver relatively moves the head unit along the sub scan direction with respect to the medium in each of an interval between the main scan operation which is performed while the head unit moves in the outward direction and the main scan operation which is performed while the head unit moves in the homeward direction, and the interval between the main scan operation which is performed while the head unit moves in the homeward direction and the main scan operation which is performed while the head unit moves in the outward direction.

4. The printing device according to claim 1, wherein the controller sets a density of printing to be performed by the plurality of individual nozzles of the nozzle row of the head unit, such that, with respect to a central portion of the nozzle row in the sub scan direction, a manner of density variation in a direction toward a head front end side which is an opposite direction to the head rear end side becomes symmetrical to a manner of density variation in a direction toward the head rear end side.

5. The printing device according to claim 4, wherein the controller sets a density of printing to be performed by the plurality of individual nozzles, such that a density of printing to be performed by the nozzles of the central portion of the nozzle row in the sub scan direction are higher than a density of printing to be performed by the nozzles of the ends of the nozzle row, and a density gradually decrease as a distance from the central portion increases.

6. The printing device according to claim 4, wherein the head unit includes a plurality of inkjet heads which is lined up in a staggered shape, the plurality of individual inkjet heads has nozzle rows in which the nozzles are lined up along the sub scan direction, respectively, and the controller sets a density of printing to be performed by the plurality of nozzles included in the nozzle rows of the individual inkjet heads, such that a density of printing to be performed by the nozzles of the central portion of the nozzle rows in the sub scan direction are high, and a density of printing gradually decrease as a distance from the central portion increase.

7. A printing method of performing printing in an inkjet scheme, comprising:

making a head unit, which includes a nozzle row in which a plurality of nozzles for ejecting ink drops of ultraviolet curing ink onto a medium is lined up, perform:

a main scan operation of ejecting ink drops while moving in a main scan direction which is predetermined; and a sub scan operation of relatively moving with respect to the medium along a sub scan direction perpendicular to the main scan direction, wherein, in the nozzle row of the head unit, the plurality of nozzles is lined up along the sub scan direction, the main scan operation of the head unit is controlled such that the head unit performs printing on the medium in a multi-pass mode for performing multiple times of the main scan operation on a same area of the medium, and performs the main scan operation corresponding to each of a predetermined N-number of printing passes on the same area of the medium, wherein N is an integer of three or greater, in a control of the main scan operation, at least a density of printing to be performed in a k-number of last printing passes of the N-number of printing passes to be performed on the same area of the medium are set so as to be lower than a density of printing to be performed in the (N−k)-th printing pass, wherein k is an integer which is equal to or greater than 1 and is less than N and in a case where a direction from a nozzle of the nozzle row of the head unit for ejecting ink drops in a first printing pass of the N-number of printing passes toward a nozzle for ejecting ink drops in a N-th printing pass is referred to as a head rear end side, and a density of printing to be performed by a plurality of individual nozzles of the nozzle row of the head unit for ejecting ink drops in the (N−k+1)-th printing pass are set so as to gradually decrease toward the head rear end side.

* * * * *